US012378825B2

(12) United States Patent
Roldan Saldes

(10) Patent No.: US 12,378,825 B2
(45) Date of Patent: Aug. 5, 2025

(54) ROTARY CONE BIT COMPRISING AN IDENTIFICATION TAG

(71) Applicant: SANDVIK MINING AND CONSTRUCTION TOOLS AB, Sandviken (SE)

(72) Inventor: Raul Roldan Saldes, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 18/562,518

(22) PCT Filed: May 20, 2022

(86) PCT No.: PCT/EP2022/063782
§ 371 (c)(1),
(2) Date: Nov. 20, 2023

(87) PCT Pub. No.: WO2022/243538
PCT Pub. Date: Nov. 24, 2022

(65) Prior Publication Data

US 2024/0247550 A1 Jul. 25, 2024

(30) Foreign Application Priority Data

May 21, 2021 (EP) ..... 21175411

(51) Int. Cl.
*E21B 12/00* (2006.01)
*E21B 10/08* (2006.01)
*E21B 10/18* (2006.01)

(52) U.S. Cl.
CPC ..... *E21B 12/00* (2013.01); *E21B 10/08* (2013.01); *E21B 10/18* (2013.01)

(58) Field of Classification Search
CPC ..... E21B 10/08; E21B 10/12; E21B 10/18; E21B 12/00; E21B 10/42; E21B 47/013;
(Continued)

(56) References Cited

U.S. PATENT DOCUMENTS

2005/0104176 A1 5/2005 Rodney et al.
2006/0065395 A1* 3/2006 Snell ..... E21B 47/01 175/45

(Continued)

FOREIGN PATENT DOCUMENTS

GB 2580545 A 7/2020
WO 2012128735 A1 9/2012

OTHER PUBLICATIONS

Grinrod et al: "SPE/IADC 163449 RFID. A Key Enabler In Drilling Automation", 2013 SPE/IADC Drilling Conference and Exhibition, Mar. 7, 2013, pp. 1-10, Retrieved from the Internet: URL: www.onepetro.org.

*Primary Examiner* — Yong-Suk (Philip) Ro
(74) *Attorney, Agent, or Firm* — Corinne R. Gorski

(57) ABSTRACT

A rotary cone rock bit having a forward end and a rearward end, includes a bit body having a plurality of legs extending therefrom. Each of the legs have an outer surface that includes a leading surface, a center panel surface, and a trailing surface and at least one nozzle. A roller cone is rotatably supported on each of the legs. The rotary cone bit further includes at least identification tag for storing product identification information and/or drilling operation information. The at least one identification tag is positioned on the trailing surface of at least one of the legs.

7 Claims, 1 Drawing Sheet

(58) Field of Classification Search
CPC ..... E21B 47/13; E21B 47/007; E21B 47/138; E21B 47/01
See application file for complete search history.

(56) References Cited

U.S. PATENT DOCUMENTS

| | | | | |
|---|---|---|---|---|
| 2009/0205820 | A1 | 8/2009 | Koederitz et al. | |
| 2016/0342916 | A1 | 11/2016 | Arceneaux et al. | |
| 2017/0030181 | A1 | 2/2017 | Thomas et al. | |
| 2020/0332652 | A1 | 10/2020 | Sehsah et al. | |
| 2021/0032936 | A1* | 2/2021 | Zhan | E21B 47/01 |

* cited by examiner

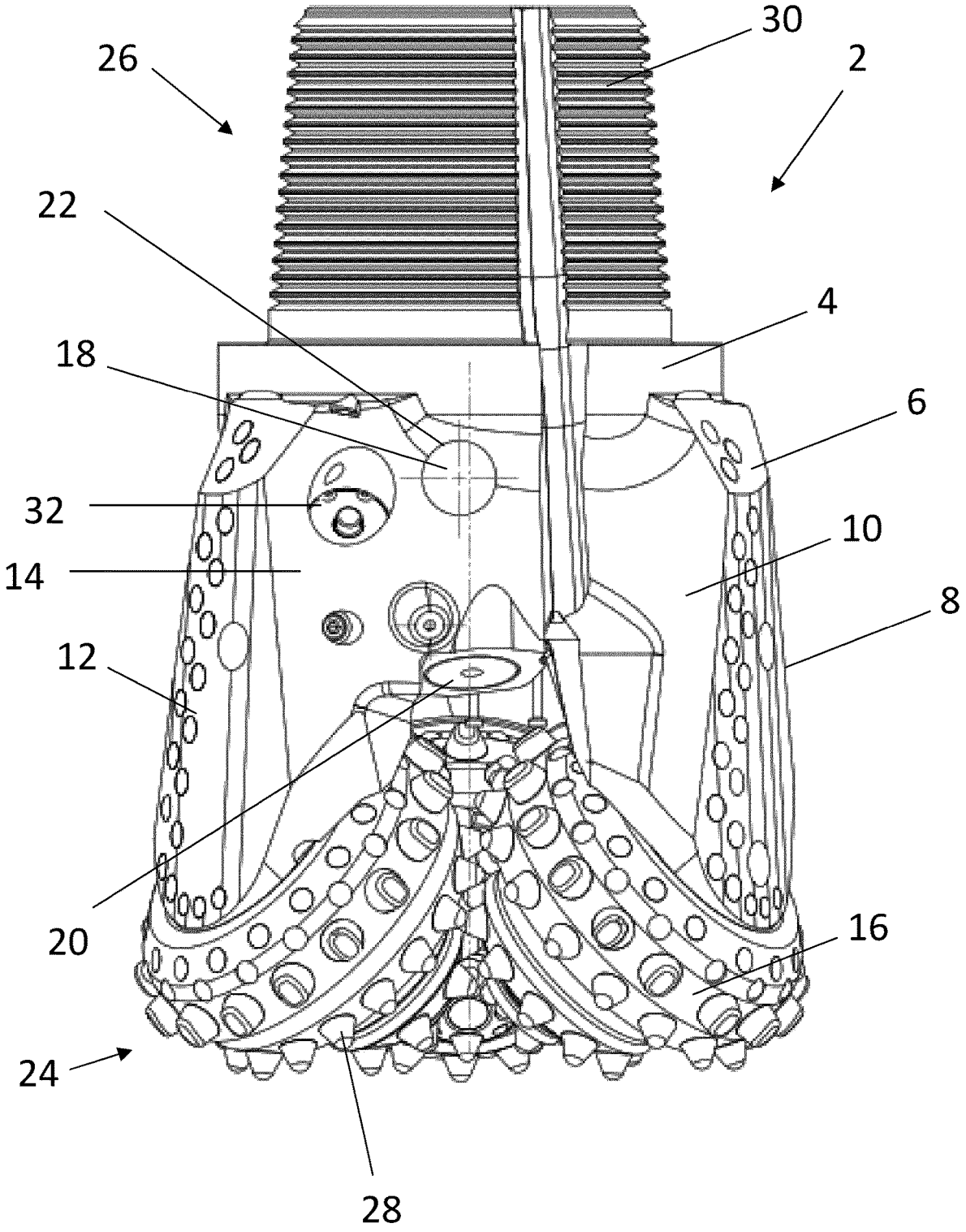
30
26
2
22
4
18
6
32
10
14
8
12
20
16
24
28

ROTARY CONE BIT COMPRISING AN IDENTIFICATION TAG

RELATED APPLICATION DATA

This application is a § 371 National Stage Application of PCT International Application No. PCT/EP2022/063782 filed May 20, 2022 with priority to EP 21175411.4 filed on May 21, 2021.

FIELD OF INVENTION

The present invention relates to a rotary cone bit comprising an identification tag.

BACKGROUND ART

Rotary cone bits are normally identified using a pin, wherein the product information, such as serial number, part number, model number etc are stamped on the component.

It would be advantageous for the information to be able to be stored in a digital format, so that not only could the efficiency of how the component identification information be improved so that the components are easier to identify and locate, but also that additionally data collected during the drilling operation can be collected and stored in a simple way on the drill component. Rotary cone bits are subjected to harsh environments, therefore further problems to overcome are how to provide digital information storage that is reliable, i.e. will not become detached from the drill component or be damaged during the operation when exposed to high temperatures, dust and dirt and that is able to reliably transmit the information to an external source.

Therefore, the problem to be solved is how provide reliable storage of information on a rotary cone bit in a digital format.

SUMMARY OF THE INVENTION

It is an objective of the present invention to provide reliable storage of information on a rotary cone bit in a digital format. This objective is achieved by providing a rotary cone rock bit having a forward end and rearward end, comprising: a bit body including a plurality of legs extending therefrom, each of said legs having an outer surface that includes a leading surface, a centre panel surface, and a trailing surface and at least one nozzle; a roller cone rotatably supported on each of said legs; the rotary cone bit further comprises at least one identification tag for storing product identification information and/or drilling operation information characterized in that the at least one identification tag is positioned on the trailing surface of at least one of the legs.

Advantageously, the inclusion of the identification tag onto the rotary cone rock drill provides a means of digital information storage, which is a more efficient process. It enables easier stock control and locating of the bits and information acquisition. Furthermore, by positioning on the trailing surface of the legs that is advantageous because they are less exposed to wear and therefore the steel surrounding the identification tag is less likely to be eroded away, thus decreasing the chance that the identification tag will become dislodged and lost during the drilling operation.

Preferably, the at least one identification tag is positioned on the rearward side of one of the nozzles. Advantageously, the supply of fluid from the nozzle will prevent debris from accumulating in this area, therefore the steel in this area of the leg is less prone to erosive wear. Therefore, the identification tag has the lowest possibility of being lost during the drilling operation if positioned above one of the nozzles and so the survival rate of the identification tag is increased.

Preferably, there is a drill hole the bit and at least one identification tag is positioned in the drill hole. Advantageously, this position protects the identification tag from wear.

In one embodiment, the rotary cone rock bit further comprising a reservoir and wherein the identification tag is positioned in the reservoir. Advantageously, this position protects the identification tag from wear.

In one embodiment the rotary cone rock bit the identification tag is a radio frequency identification tag (RFID). Advantageously, RFID tags are able to remain intact even in harsh environments.

In one embodiment, the RFID tag is press fit in the drill hole. Advantageously, this makes the installation of the RFID tag onto the bit easy.

In another embodiment, the identification tag is is encoded with one-dimensional or two-dimensional optical machine-readable code. Advantageously, by arranging the first identification marker as a one-dimensional or two-dimensional optical machine-readable code, the first identification marker can be arranged where it is covered by metal surfaces without affecting its readability.

In one embodiment, the identification tag is a Quick Response (QR) code, a High Capacity Coloured Two Dimensional Code, a European Article Number code, a DataMatrix code, or a MaxiCode. Preferably, the identification marker is a DataMatrix code. Advantageously if a data matrix code is used more information can be stored in a smaller area. Further, only approximately 32-72% of the data matrix code needs to be intact in order for the information to be read, therefore even if the data matrix code is slightly damaged the information can still be read. It may be preferable that the ID tag used has an industry standard associated with it.

In one embodiment, the identification tag is etched, engraved, impressed, imprinted, or painted on. Advantageously, by having the identification marker etched, engraved, impressed, imprinted, or painted to the first coupling part there is no need of any special marker holding units which would require a special design of the processing tool body in order to make room for such a marker holding unit. A further benefit of not requiring a special marker holding unit is that the risk of unbalances in the processing tool body can be reduced. Preferably the identification marker is laser engraved onto the base of the indentation. Advantageously, the desired location can be reached most easily using a laser.

Optionally, the rotary cone drill bit further comprises a second identification tag positioned on a surface that is not exposed to the external environment once the bit is connected to a carrier, such as a drill string. Advantageously, this provides the combination of an external identification that is easily accessible for reading the data without having to disassemble the rotary cone drill bit together with an identification tag positioned internally, which will not be exposed to wear, thus providing a backup in case the externally positioned identification tag is worn away.

Preferably, the second identification tag is encoded with one-dimensional or two-dimensional optical machine-readable code. Preferably, the second identification tag is a data matrix.

BRIEF DESCRIPTION OF DRAWINGS

A specific implementation of the present invention will now be described, by way of example only, and with reference to the accompanying drawings in which:

FIG. 1 is a schematic drawing of a rotary cone bit comprising an identification tag.

DETAILED DESCRIPTION

FIG. 1 shows a rotary cone bit 2 with a forward end 24 and a rearward end 26. The bit 2 having a bit body 4 with a plurality of legs 6 extending therefrom. Each leg 6 supports a roller cone 16 having a multitude of protruding cutting elements 28 for engaging the earthen formation and boring the bore hole as the bit 2 is rotated. Typically, rotary cone bits 2 have three legs 6 and roller cones 16 although the present invention may be used in bits 2 with any number of legs 6 and roller cones 16. The bit 2 further comprises a connector 30, which is typically threaded, for connecting the bit 2 to the carrier, such as a drill string (not shown).

Each leg 6 includes a leading surface 10, a centre pane 12 and a trailing surface 14, all of which form an outer surface 8 of the leg 6. As the bit 2 rotates during operations, the leading surface 10 of each leg 6 leads the rotational path, followed by the centre panel 12, following by the trailing surface 14. During drilling, as well as extraction of the bit 2 from the bore holes (not shown), the legs 6 will contact earthen cuttings. Generally, the leading surface 10 and the central panel 12 experience such contact, while the trailing surface 14 is substantially blocked from significant contact with earthen cuttings and the bore hole wall by the leading surface 10, the central panel 12 and the rest of the leg 6.

A plenum (not shown) extends through the bit 2 to allow the supply of circulation fluid (not shown) to one or more nozzles 20 formed in legs 6, as is known in the art. The nozzles 20 operate to direct pressurized fluid against the bottom of the bore hole to lift earthen cuttings and other debris up through the bore hole (not shown). The nozzles 20 also direct the circulation fluid over the roller cones 16 and cutting elements 28 to free debris accumulating thereabout. The bit 2 further comprises a reservoir 32 for providing lubricant, such as grease to a roller bearing system (not shown).

At least identification tag 18 is attached to the rotary cone bit 2 positioned on the trailing surface 14 of at least one of the legs 6.

Before installation onto the bit 2, the identification tag 18 can be pre-programmed with information relating to the component, including, but not limited to, the serial number, part number, component size, component type, tool parameters, service information. Therefore, enabling digital identification and traceability of the component.

During the drilling operation, further information can be collecting, including, but not limited to drilling parameters such as metres drilled, lifetime of the component, service life, comments from the operator and failure mode. Therefore, enabling digital retrieval and storage of the drilling data so that the drilling tool management efficiency can be effectively improved, and the manual labour intensity is reduced.

Preferably, there is only one identification tag 18 per bit 2, but more than one identification tag 18 could be included.

Preferably, the at least one identification tag 18 is positioned on the rearward side of one of the nozzles 20, in other words above one of the nozzles. This means that the identification tag is positioned in between the nozzle 20 and the connector 30, in other words the identification tag is positioned further from the cutting elements 28 compared to the nozzle 20.

Preferably the identification tag 18 is positioned on the trailing surface 14 of at least one of the legs 6 on the rearward side of the one of the nozzles 20.

Preferably, there is a drill hole 22, otherwise known as a milled hole or indentation or recess on the bit 2 and at least one identification tag 18 is positioned into the drill hole 22.

Alternatively, the identification tag 18 is positioned in the reservoir 32. This could be either by directly positioning the identification tag 18 on one of the surfaces of the reservoir 32 or could via an attachable mean.

In one embodiment the identification tag 18 is a radio frequency identification tag (RFID). An RFID uses electromagnetic fields to automatically identify and track tags attached to objects. An RFID system consists of a tiny radio transponder, a radio receiver and transmitter. When triggered by an electromagnetic interrogation pulse from a nearby RFID reader device, the tag transmits digital data.

Preferably, the RFID tag 18 is press fit into the drill hole 22.

Alternatively, the RFID tag 18 could be held in position using epoxy resin or other adhesive, via a threaded attachment, or any other suitable means to keep the RFID tag 18 attached to the bit to ensure the RFID tag 18 is not lost during the drilling operation.

Preferably, the RFID tag 18 is left uncovered to increase the signal transmission, however it could instead be covered, for example with a cap or epoxy resin or any other suitable covering that would increase the prevention of wear around the RFID tag 18 so that the change of the survival of the RFID tag 18 during the drilling operation is increased.

The data from the RFID tag 18 can be transmitted back to a reader box (not shown), that is typically positioned on the rig (not shown). Optionally, there could be a second RFID tag (not shown) positioned on the reader box to improve the signal.

In another embodiment, the identification tag 18 comprises identification data encoded in a one-dimensional or two-dimensional optical machine-readable code. For example, the identification tag 18 could be a Quick Response (QR) code, a High Capacity Coloured Two Dimensional Code, a European Article Number code, a DataMatrix code, or a MaxiCode. A data matrix code is a two-dimensional bar code which may be in the form of a square or rectangular symbol made up of individual modules of predetermined size in the form of dots or squares. The individual modules form an ordered grid of contrasting (e.g. dark or light) modules, bordered by a finder pattern used to specify the orientation and structure of the symbol. The identification tag can in this case be used to store information about a very large amount of individual sintered bodies, depending on the size of the data matrix code. The size may typically be 12×12 modules, or larger depending on needs. In an error correction algorithm, several damaged or blurred modules can be corrected for.

According to one embodiment, the identification tag 18 is etched, engraved, impressed, imprinted or painted on. A particularly suitable way of arranging the identification tag 18 by laser engraving.

The invention claimed is:

1. A rotary cone rock bit having a forward end and a rearward end, the rotary cone rock bit comprising:

a bit body including a plurality of legs extending therefrom, each of said legs having an outer surface that includes a leading surface, a centre panel surface, and a trailing surface and at least one nozzle;

a roller cone rotatably supported on each of said legs; and at least one identification tag arranged for storing product identification information and/or drilling operation information, wherein the at least one identification tag is positioned in the trailing surface of at least one of the legs and on a rearward side of one of the at least one nozzle.

2. The rotary cone rock bit according to claim 1, wherein there is a drill hole on the bit and wherein the at least one identification tag is positioned in the drill hole.

3. The rotary cone rock bit according to claim 1, wherein the identification tag is a radio frequency identification tag (RFID).

4. The rotary cone rock bit according to claim 3, wherein the RFID tag is press fit in the drill hole.

5. The rotary cone rock bit according to claim 1, wherein the identification tag is encoded with one-dimensional or two-dimensional optical machine-readable code.

6. The rotary cone rock bit according to claim 5, wherein the identification tag is a Quick Response (QR) code, a High Capacity Coloured Two Dimensional Code, a European Article Number code, a DataMatrix code, or a MaxiCode.

7. The rotary cone rock bit according to claim 5, wherein the identification tag is etched, engraved, impressed, imprinted, or painted on.

* * * * *